United States Patent [19]

Kile

[11] Patent Number: 4,549,496

[45] Date of Patent: Oct. 29, 1985

[54] APPARATUS AND METHOD FOR PRODUCING PATTERNED TUFTED GOODS

[75] Inventor: H. Buford Kile, Rossville, Ga.

[73] Assignee: Fabrication Center, Inc., Dalton, Ga.

[21] Appl. No.: 590,504

[22] Filed: Mar. 16, 1984

[51] Int. Cl.[4] ..... D05C 15/02

[52] U.S. Cl. ..... 112/79.5; 112/79 FF

[58] Field of Search ..... 112/79.5, 79 FF, 79 A, 112/79

[56] References Cited

U.S. PATENT DOCUMENTS

| | | | |
|---|---|---|---|
| Re. 27,165 | 8/1971 | Spanel et al. | 112/79 |
| Re. 30,100 | 9/1979 | Spanel et al. | 112/79 |
| 2,862,465 | 12/1958 | Card | 112/79 |
| 2,989,014 | 6/1961 | Dedmon | 112/79 |
| 3,160,125 | 12/1964 | Bryant et al. | 112/79 |
| 3,216,387 | 11/1965 | Short | 112/410 |
| 3,217,675 | 11/1965 | Short | 112/79 |
| 3,220,371 | 11/1965 | Short et al. | 112/266 |
| 3,249,078 | 5/1966 | Nowicki | 112/266 |
| 3,263,631 | 8/1966 | Freeman | 112/79 |
| 3,338,198 | 8/1967 | Short et al. | 112/410 |
| 3,375,797 | 4/1968 | Gaines | 112/79 |
| 3,450,076 | 6/1969 | Bender | 112/79 R |
| 3,595,185 | 7/1971 | Shorrock et al. | 112/79 |
| 3,670,672 | 6/1972 | Spanel et al. | 112/79 |
| 3,756,173 | 9/1973 | Shorrock | 112/79 |
| 3,812,799 | 5/1974 | Spanel et al. | 112/79 |
| 3,820,430 | 6/1974 | Hautemont | 83/100 |
| 3,934,524 | 1/1976 | Smith | 112/79 |
| 3,937,156 | 2/1976 | Spanel | 112/79 |
| 3,937,157 | 2/1976 | Spanel et al. | 112/79 |
| 3,937,158 | 2/1976 | Spanel | 112/79 |
| 3,937,643 | 2/1976 | Spanel | 156/435 |
| 3,943,865 | 3/1976 | Short et al. | 112/79 R |
| 4,127,078 | 11/1978 | Spanel et al. | 112/79 |
| 4,244,309 | 1/1981 | Spanel et al. | 112/79 |

*Primary Examiner*—Ronald Feldbaum

*Attorney, Agent, or Firm*—Kerkam, Stowell, Kondracki & Clarke

[57] ABSTRACT

In an apparatus and method for producing patterned tufted goods using multicolored or multitextured yarns, continuous lengths of the different yarns are transported pneumatically to a backing opener which is moved transversely across a backing to implant a row of yarn tufts therein. The yarns supplied to the backing opener are controlled in accordance with a predetermined pattern such that at each location in the row any number of the different yarns may be selected for implantation into the backing. The movement of the backing opener may be controlled so as to select the locations in each row at which tufts are implanted, enabling goods with a varying yarn density and with a carved-style pattern to be produced.

40 Claims, 9 Drawing Figures

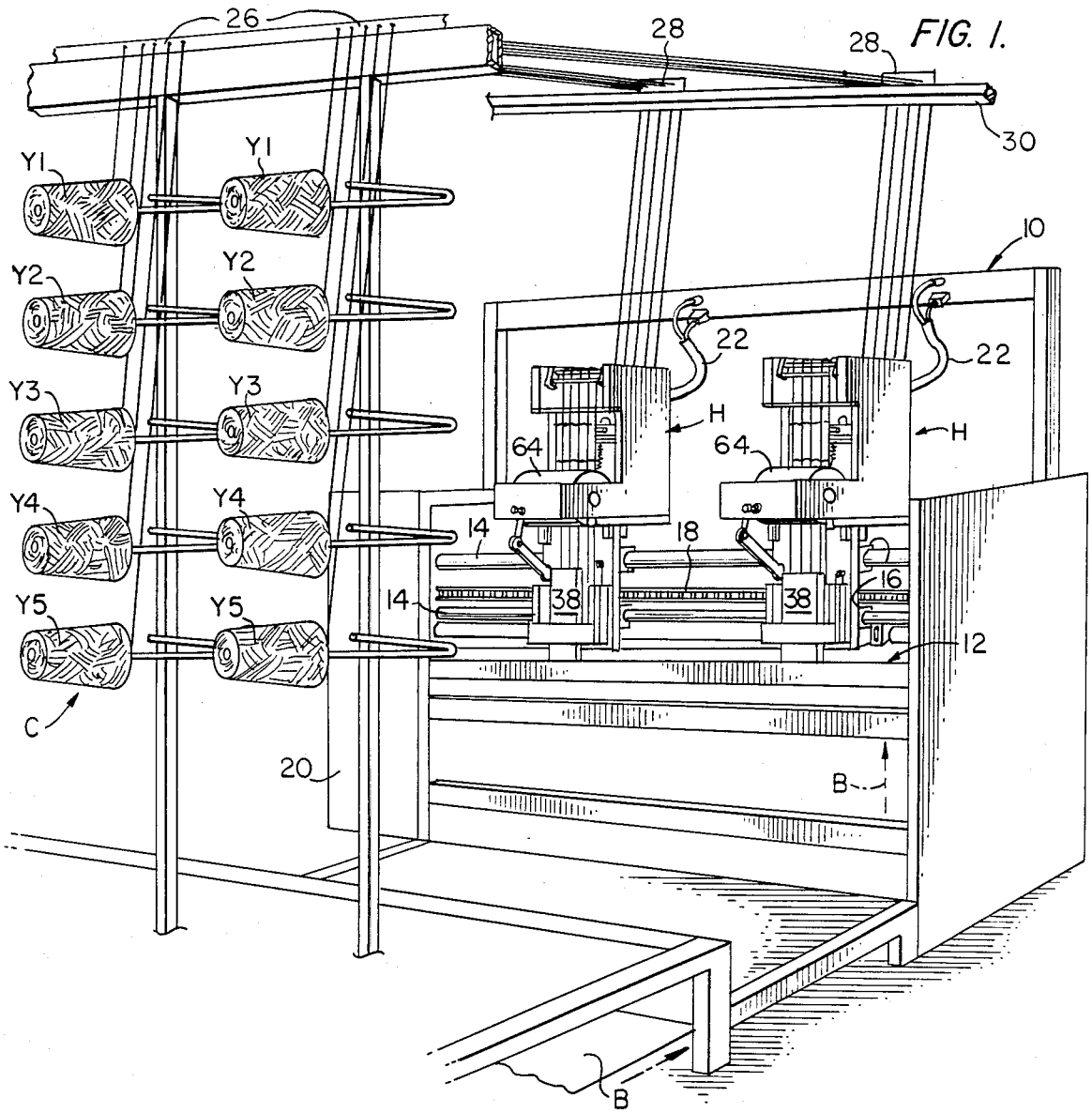
FIG. 1.
FIG. 7.
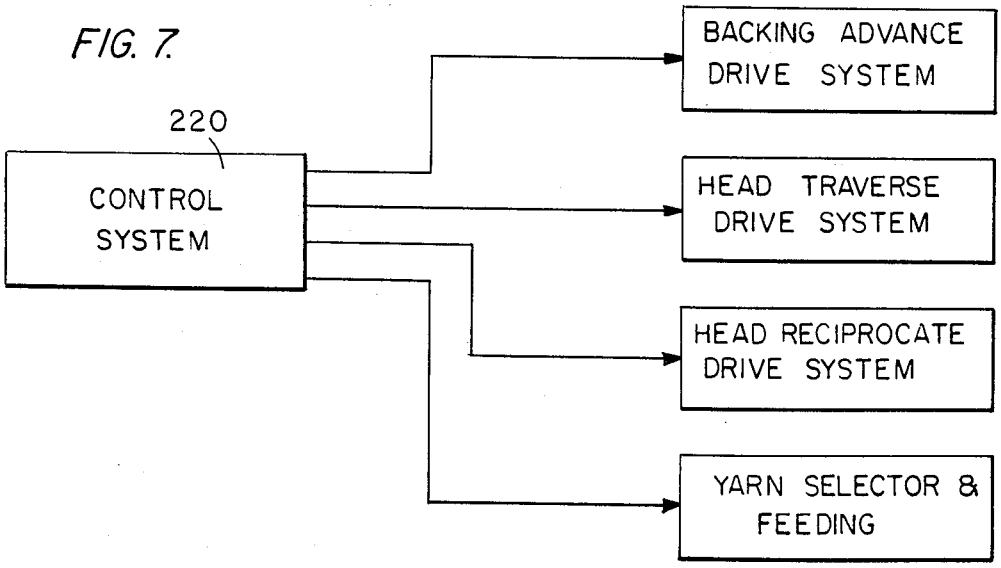

APPARATUS AND METHOD FOR PRODUCING PATTERNED TUFTED GOODS

BACKGROUND OF THE INVENTION

This invention relates generally to apparatus and methods for producing tufted goods such as carpet and the like, and more particularly to apparatus and methods for producing tufted goods embodying a pattern or design.

The realization of practical apparatus and methods capable of producing patterned tufted goods using multicolored or multitextured yarns represents, perhaps, the single greatest unsatisfied need of the tufting industry. No other need has received more time or attention, and despite the numerous proposals which have been advanced for tufting styling techniques that are capable of competing with the styling ability of a loom, none has proved to be satisfactory or commercially practical. At present, the only sources of such patterned goods are woven goods produced by a loom, or those produced using various tinting or dyeing techniques.

In order to produce tufted goods embodying patterns or designs using yarns of different colors or different textures, it is necessary to be able to select from the plurality of different yarns the particular yarn or yarns that are to be implanted in a backing for each tuft. In a conventional multineedle broadloom tufting machine, a large number, 1200, for example, of needles are connected to a reciprocating needle bar, and each needle is threaded with yarn supplied from a corresponding spool located in a yarn creel. To produce a multicolored or multitextured pattern with such machines requires the ability to change the yarn supplied to each needle for each needle stroke. This is not possible in a conventional tufting machine. Although other types of tufting machines have been proposed wherein the tufting needles are threaded each stroke with a precut length of yarn that may be selected from a plurality of different yarns, such machines are complex and have proved to be impractical. Other proposals have included modifying conventional machines to provide tandem groups of needles, each needle of a group being supplied with one of the different yarns, and either a needle selection mechanism for selecting the particular needle of a group that is actuated during each stroke, or a yarn feed mechanism for controlling the amount of yarn supplied to each needle so as to produce either a low pile for non-selected yarns that is obscured by a higher pile of the selected yarns, or for causing the non-selected yarns that are implanted to be pulled from the backing by their corresponding needles during the next needle stroke. These approaches also have proved to be complex and impractical or otherwise unsatisfactory.

It is desirable to provide apparatus and methods for providing patterned tufted goods from yarns of different colors or textures that avoid the foregoing disadvantages, and it is to this end that the present invention is directed.

SUMMARY OF THE INVENTION

The invention provides an apparatus and a method for producing patterned tufted goods using yarns of different colors or different textures that are capable of placing yarn into a backing so as to create patterns and designs that heretofore were available only from a weaving loom or by using printing techniques. Patterned tufted goods having circles, squares or other abstract designs such as logos, monograms, or photographs can be readily reproduced with remarkably absolute detail using yarns of different size, color and/or character. The yarns may vary, for example, according to fiber type, yarn size, heatset or non-heatset, or even between staple and filament. Moreover, the invention enables the selection for insertion into the backing, at each location, either all, none, or any number of the different yarns, in any combination, which affords a unique ability to create different designs and patterns by not only placing different colors or different types of yarns in different areas of a backing, it also affords the unique ability to increase or decrease the density of the tufts in any particular area within a design. By omitting tufts in different locations, a carved-style pattern may be readily produced. Other advantages of the invention include its simplicity, its remarkable flexibility, and obviation of a creel of the type required by conventional tufting machines that contains a large number of spools of yarn. This latter advantage enables the production of goods using small yarn lots as, for example, for testing different yarns. These and other advantages of the invention will become apparent hereinafter.

Briefly stated, apparatus in accordance with the invention for producing patterned tufted goods comprises means for advancing a backing past a yarn-applying region at which yarn-applying means is disposed for penetrating the backing and for implanting yarn therein to form tufts. The yarn-applying means is moveable transversely with respect to the direction of advancement of the backing for implanting yarn tufts in a transverse row. Means are included for supplying a plurality of different yarns to the yarn-applying means and for controlling the supplying means in accordance with a predetermined pattern to select, at each penetration, the particular yarn or combination of yarns, if any, that are implanted in the backing.

In accordance with another aspect, the invention provides a method of producing patterned tufted goods using automatic apparatus wherein a backing is advanced past a yarn-applying region, and yarn is applied to the backing at the yarn-applying region by moving a yarn-applying element transversely across the backing. A plurality of different yarns are supplied to the yarn-applying element which successively implants yarn in the backing along a transverse row. At each location in the transverse row, the particular yarn or yarn combinations that are to be implanted are automatically selected in accordance with a predetermined pattern. In addition, the movement of the yarn-applying element may be controlled so as to enable selection of the particular locations in a row at which yarn is implanted.

In accordance with other aspects, the different yarns are transported pneumatically in continuous lengths to a backing opener by means of a yarn exchanger comprising a plurality of tubes converging at an inlet of the backing opener. At each transverse location where a tuft is to be implanted, the yarns are controlled so that the selected yarn or combination of yarns to be implanted is fed through the backing opener and applied to the backing. To avoid the formation of a back pressure in the tubes of the yarn exchanger when the number of yarns fed through the backing opener increases, pressure regulating means is included for maintaining a predetermined pressure at the inlet of the backing opener.

By controlling the location of each tuft, as well as the color, texture, and character of the particular yarn or yarns that are implanted at each location, the invention enables the production of any desired pattern or design, as well as control of the density of the resulting product.

BRIEF DESCRIPTION OF THE DRAWINGS

FIG. 1 is a perspective view of apparatus embodying the invention;

FIG. 7 is a block diagram illustrating the control of the apparatus of FIG. 1.

DESCRIPTION OF THE PREFERRED EMBODIMENT

Figure 2:
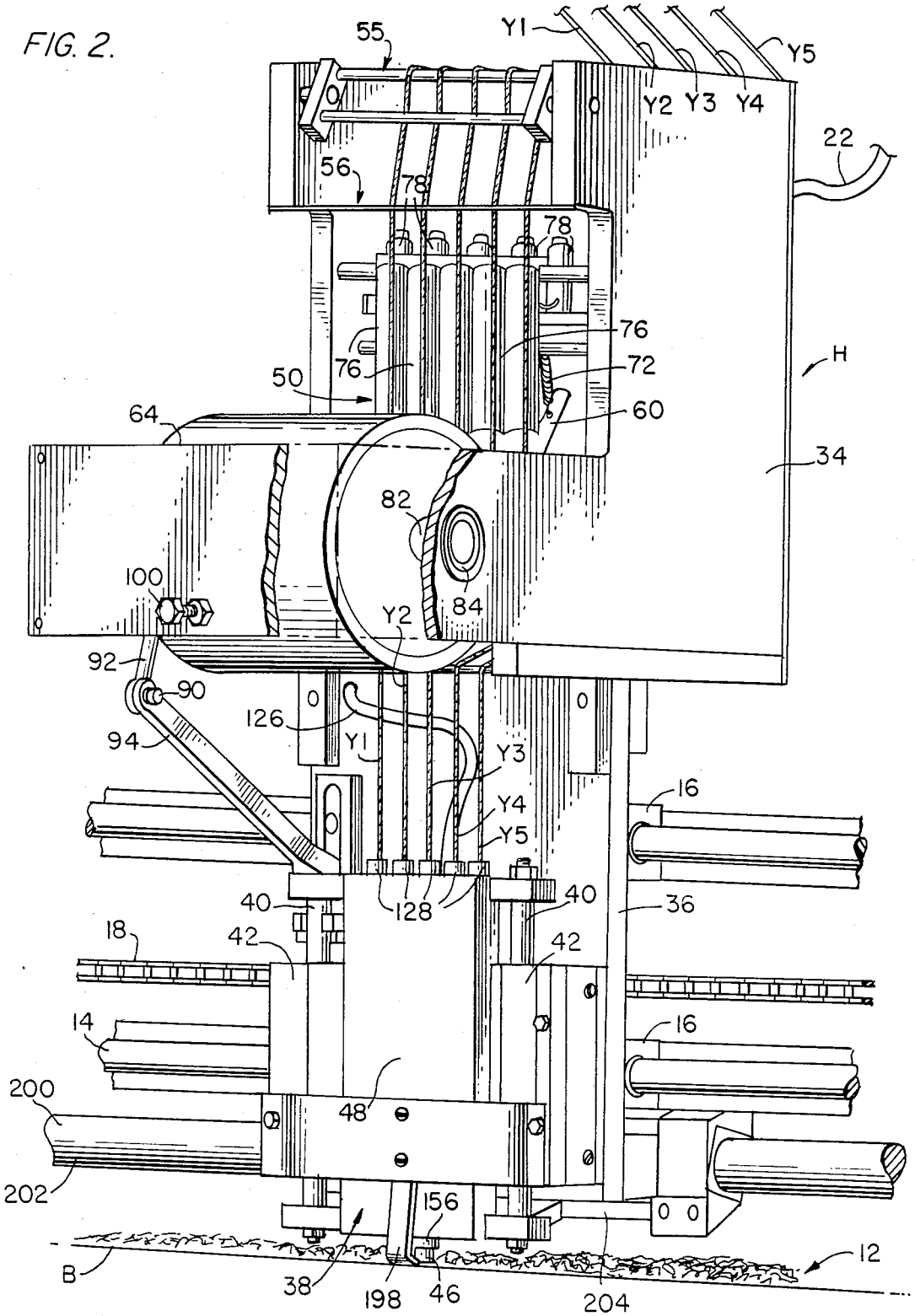
FIG. 2 is a perspective view, partially broken away, of a head assembly of the apparatus of FIG. 1.

FIG. 1 is a perspective view of an apparatus in accordance with the invention for producing patterned tufted goods such as carpet and the like from a plurality of different yarns. The yarns may differ in color, size, character and type, and may be heatset or non-heatset, or even staple and filament, in any combination. For purposes of illustration, the embodiment of the invention described herein has the capability of using up to five (5) different yarns. However, as will be appreciated, a greater or a lesser number of yarns may also be employed.

As shown in FIG. 1, and as will be described in more detail hereinafter, the apparatus may generally comprise a frame-like structure 10 having a horizontal bed or work-applying region 12 past which a web of primary backing material B, as of natural or synthetic fibers, is advanced. A plurality of transversely moveable head assemblies H (only two being illustrated in FIG. 1) may be supported on the frame at region 12 for transverse movement with respect to the direction of advancement of the backing, as by a pair of fixed elongated rod-like supports 14 extending the width of the bed and corresponding low friction linear bearings 16. The head assemblies may be connected to a head traverse drive system comprising, for example, a drive chain 18 which is driven by an electric, pneumatic, or hydraulic indexing system (not illustrated) housed in an enclosure 20 disposed at one side of the apparatus for moving the plurality of head assemblies in synchronism transversely across the primary backing. Each head assembly is a self-contained unit which receives all of the plurality of the different yarns Y1–Y5 that are to be used in producing the patterned goods, and, in response to control signals supplied to the head assembly via a cable 22 as the head assembly traverses the primary backing, selects the particular yarns or yarn combinations to be implanted at each location and implants the selected yarns or yarn combinations into the primary backing. As shown, the yarns are supplied in continuous lengths to each head assembly from individual spools or packages of the different yarns located in a yarn creel C. A complete set of spools of the different yarns is associated with each head assembly, and the yarns from the spools are guided to the head assemblies by fixed yarn guides 26 and 28 located, respectively, at the creel and on a frame member 30 adjacent to the head assemblies.

For the apparatus illustrated in FIG. 1 the two head assemblies are preferably spaced apart one-half the width of the primary backing. Each head assembly traverses a distance equal to one-half the width so that together the two head assemblies implant a complete transverse row of yarn tufts in the primary backing, the left-hand head assembly covering the left half of the primary backing and the right-hand head assembly covering the right half. Although only two head assemblies are illustrated in FIG. 1, in preferred form the apparatus may employ a larger number of head assemblies (which is advantageous for increasing production speed), in which case the spacing between adjacent head assemblies and the distance each traverses would be adjusted accordingly such that the entire width of the primary backing would be traversed. For a fifteen foot wide primary backing, for example, the apparatus may employ 23 head assemblies spaced approximately eight inches apart, each traversing approximately an eight inch segment of the total width.

Figures 3, 6A, 6B, 6C:
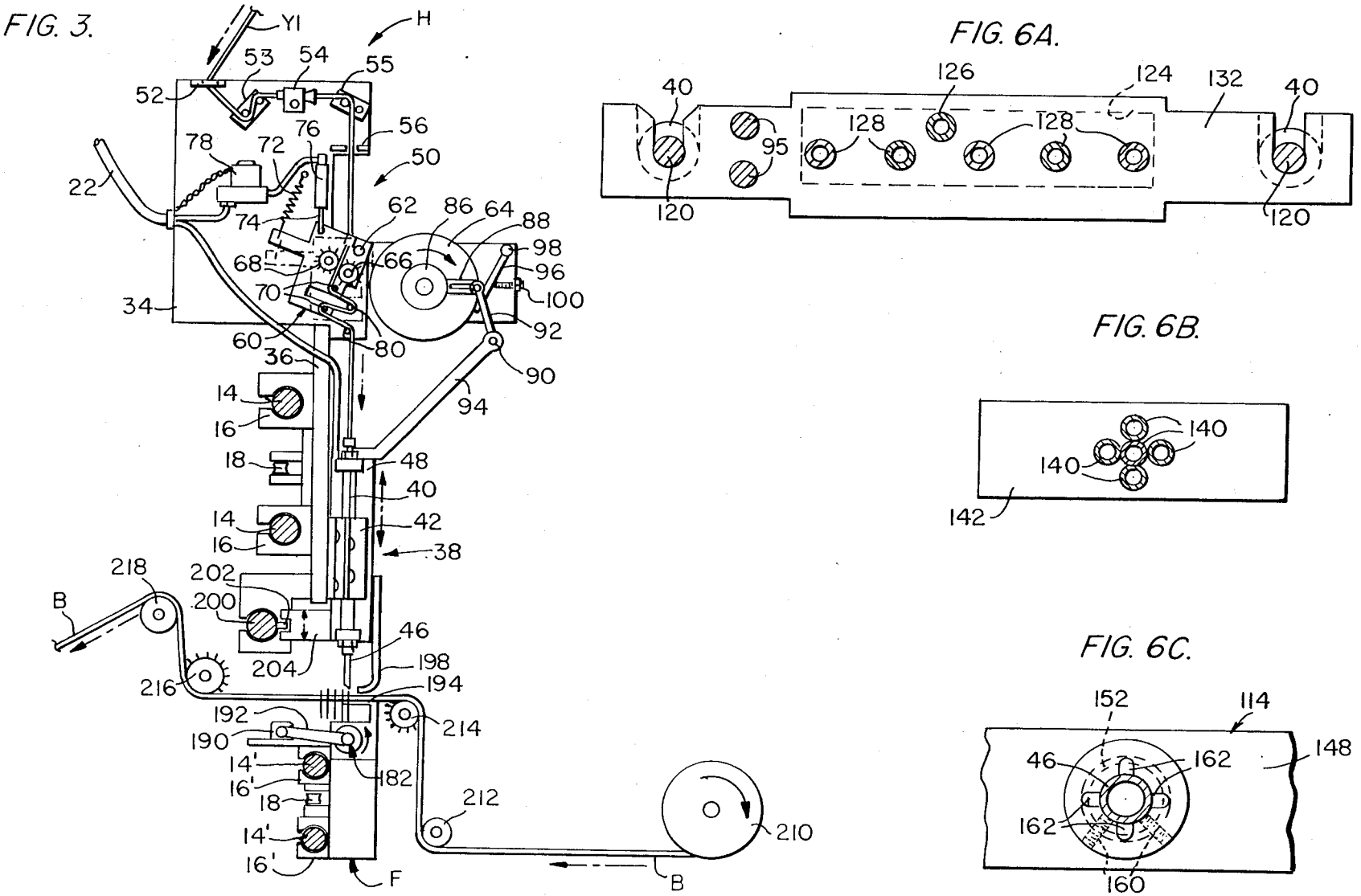
FIG. 3 is a schematic view illustrating the construction of the apparatus of FIG. 1.
FIGS. 6A–C are cross sectional views taken, respectively, approximately along the lines 6A—6A, 6B—6B, and 6C—6C of FIG. 4.

FIGS. 2 and 3 illustrate in more detail one of the head assemblies H. The head assembly comprises an upper structure 34 carried by a vertical member 36 to which are affixed the linear bearings 16 for supporting the head assembly on supports 14. A reciprocating yarn-applying element 38 is carried on member 36 and may be connected thereto by means of vertically extending cylindrical guide rods 40 which pass through low friction linear bearings 42 connected to the member 36 so as to enable the yarn-applying element to be reciprocated vertically (by a drive system to be described). As will be described in more detail shortly, the yarn-applying element comprises a hollow backing opener tube 46 adapted to penetrate the primary backing to implant yarn therein, and a yarn exchanger 48 which supplies the plurality of yarns Y1–Y5 to the backing opener. As will also be described shortly, yarn selector and feed mechanisms 50 (one for each of the yarns) are disposed in the upper structure 34 of the head assembly for controlling, in response to signals supplied thereto, the selection and feeding of the plurality of different yarns to the yarn exchanger and the backing opener.

As shown in FIGS. 1 and 2, each head assembly receives all of the different yarns from its associated set of spools located in the yarn creel. From the yarn guides 28 (FIG. 1), the yarns may be supplied to the upper rear portion of each head assembly. As best illustrated in FIG. 3 (which illustrates only yarn Y1) the yarns entering the head assembly pass through a series of yarn guides 52, 53, 54, 55, and 56. Guides 52 and 56 may simply comprise horizontal plates connected to structure 34 that have an aperture therein for each of the different yarns and which serve to maintain a desired spacing between each of the yarns. Guides 53 and 55 may be similar and may comprise a pair of parallel rods which extend between end members that are pivotally connected to structure 34, as best illustrated in FIG. 2 for guide 55, so as to enable the positions of the rods to be adjusted. Guide 54, which is disposed between guides 53 and 55, comprises a tubular member (one for each of the different yarns) through which the yarn passes. If a yarn should break, or if a large body of yarn should try to pass through this tube a shut-off switch (not illustrated) will be activated. In addition to maintaining the desired spacing between the yarns, the yarn guides apply a slight tension to the yarns and assist the yarn feeding mechanisms in pulling the yarns from their individual spools as the head assemblies move back and forth across the primary backing. From guide 56, the yarns are fed to the yarn selector and feeding mechanisms 50, which will now be described.

The yarn selector and feeding mechansims 50, which are preferably identical, each comprise a yarn selector portion for selecting the desired yarns for implantation and a yarn feeding portion for supplying a length of yarn greater than a predetermined length. As shown in FIG. 3 (which illustrates the yarn selector and feeding mechanism for yarn Y1), each yarn selector and feeding mechansim comprises a base member 60 pivotally supported on structure 34, as by a transversely extending rod 62, adjacent to a cylindrical drum 64 which preferably has a surface of resilient material such as rubber and which, as will be described, serves as a common drive roller for all of the yarn feeding portions of the mechanisms. Base member 60 carries a pair of rotatable intermeshed gears or rollers 66 and 68, between which the yarn is fed, and carries a pair of yarn guides 70 about which the yarn is threaded, as shown in FIG. 3. Base member 60 is biased, as by a spring 72, in a clockwise direction to the solid line position shown in the figure. The moveable plunger 74 of a yarn selector actuator 76 that is carried on the upper structure is attached to the base member as shown. The actuator may be, for example, a pneumatic actuator controlled by a pneumatic solenoid valve 78, as shown, or it may be an electrical or hydraulic actuator. Structure 34 may also carry another pair of fixed yarn guides 80 (which may also be transversely extending rods) which cooperate with yarn guides 70 carried by the base member to impart (when the base member is in the solid line position) a tortuous path of predetermined length to the yarn between gears 66 and 68 and the inlet of the yarn exchanger, as shown in FIG. 3. As described hereinafter, this tortuous path serves as a temporary storage for the predetermined length of yarn.

Upon actuator 76 being actuated, as by a control signal supplied to valve 78 via cable 22, plunger 74 of the actuator extends and causes the base member to pivot (counter-clockwise in the figure) about rod 62 to the phantom line position illustrated. With the base member pivoted to this position, gear 66 engages the surface of drum 64, and yarn guides 70 and 80 assume a substantially co-linear relationship so that the tortuous path of the yarn between the guides is converted to a substantially straight path. This releases the stored predetermined length of yarn corresponding to the length of the tortuous path so that it may be transported to the yarn exchanger. Preferably, the length of yarn stored in the tortuous path is sufficient to enable the end of the yarn to exit the outlet of the backing opener so it can be cut, as described hereinafter. Drum 64 is rotatably supported on a forwardly projecting portion of structure 34 as by a shaft 82 received in bearings 84 (one of which is shown in FIG. 2). As shown in FIG. 3, a one-way clutch or ratchet 86 having a slotted arm 88 may be connected to shaft 82 at one side of the drum, and an arm 88 may be coupled by a pair of pivotally connected (at 90) link members 92 and 94 to the reciprocting yarn exchanger 48 to enable the drum to be rotatably driven by the reciprocating yarn-applying element. Link member 94 may be connected to the yarn exchanger by screws 95, for example, as best shown in FIG. 4.

In FIG. 3, the yarn exchanger is shown at the top of its stroke at which the backing opener 46 is positioned above the backing B. As the yarn exchanger moves downwardly to cause the backing opener to penetrate the backing, link members 92 and 94 cause drum 64 to undergo a clockwise angular rotation. This imparts a counter-clockwise angular rotation to gear 66, which is in engagement with the surface of drum 64, and causes a length of yarn greater than a predetermined length sufficient to ensure that the yarn extends beyond the outlet of the backing opener at the bottom of its stroke and is cut, as described hereinafter, to be fed through gears 66 and 68 and supplied to the yarn exchanger. When the yarn exchanger moves upwardly during the second half of its stroke, one-way clutch 86 rotates counter-clockwise and slips so that drum 64 remains stationary and is not rotated in the opposite direction. Gears 66 and 68 likewise remain stationary during this time, which serves to hold the yarn securely. This prevents previously supplied yarn from being pulled back, which is undesirable. To minimize free-wheeling or backward (counter-clockwise) rotation of the drum due to friction in the one-way clutch, a transversely extending plate 96 pivoted about an edge 98 thereof may be provided for frictionally engaging the surface of the drum so as to resist counter-clockwise rotation of the drum. The frictional engagement between the surface of the drum and plate 96 may be adjusted, as by means of a screw 100. Accordingly, as the yarn-applying element reciprocates upwardly and downwardly to implant yarn into the backing, drum 64 undergoes successive incremental clockwise angular rotations so as to feed the selected yarns to the yarn exchanger during its downward stroke. The amount of yarn supplied to the yarn exchanger may be controlled by controlling the amount of angular rotation of the drum, which may be adjusted by adjusting the location at which link member 92 connects to slotted arm 88.

As previously noted, the apparatus of the invention has the capability of implanting any number and any combination of the different yarns into the backing. The precise manner in which this is accomplished will be described shortly. However, it is sufficient at this point to note that, as previously indicated, each of the yarns has its own yarn selector and feeding mechanism. (FIG. 2 illustrates the five actuators 76 and associated valves 78 corresponding to the five yarns Y1–Y5.) Selection and feeding of the desired yarns is accomplished by supplying control signals to the appropriate valves 78 to actuate the actuators associated with the selected yarns. The selected yarns are then fed to the yarn exchanger by the rotation of drum 64 as long as their corresponding actuators remain actuated. Upon an actuator being deactuated, its corresponding base member 60 is returned to the solid line position indicated in FIG. 3 by spring 72. The moveable yarn guides 70 carried by the base member cause the yarn to be pulled around the fixed yarn guides 80 so that the yarn assumes the tortuous path indicated in FIG. 3. As will be described shortly, this serves to pull back and store a portion of the yarn previously supplied to the yarn exchanger, and gears 66 and 68 cooperate to hold the yarn and prevent it from being transported through the yarn exchanger to the backing opener.

Figure 4:
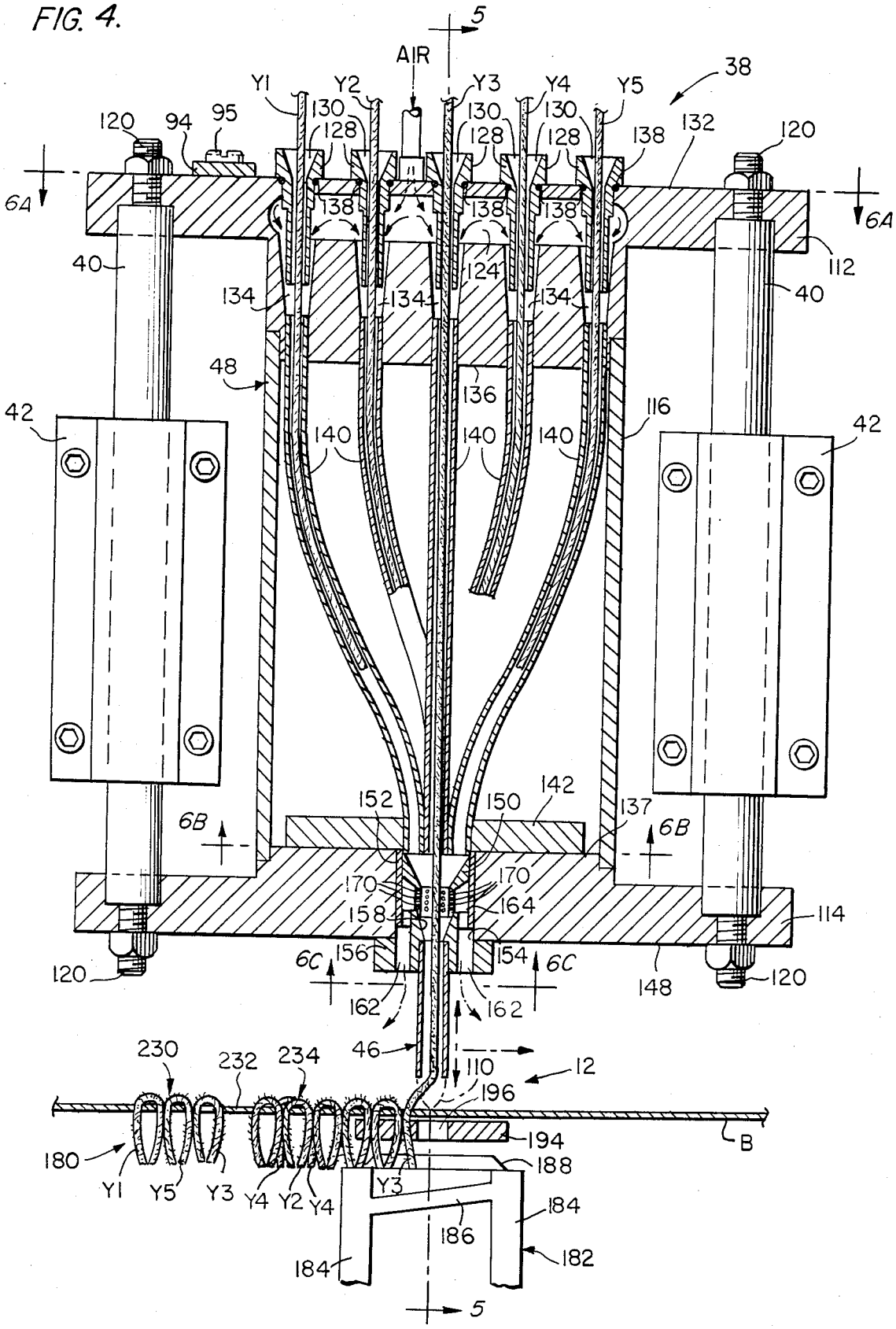
FIG. 4 is a cross sectional view taken approximately along the lines 4—4 of FIG. 5 illustrating a preferred form of a backing opener and yarn exchanger in accordance with the invention.
Figure 5:
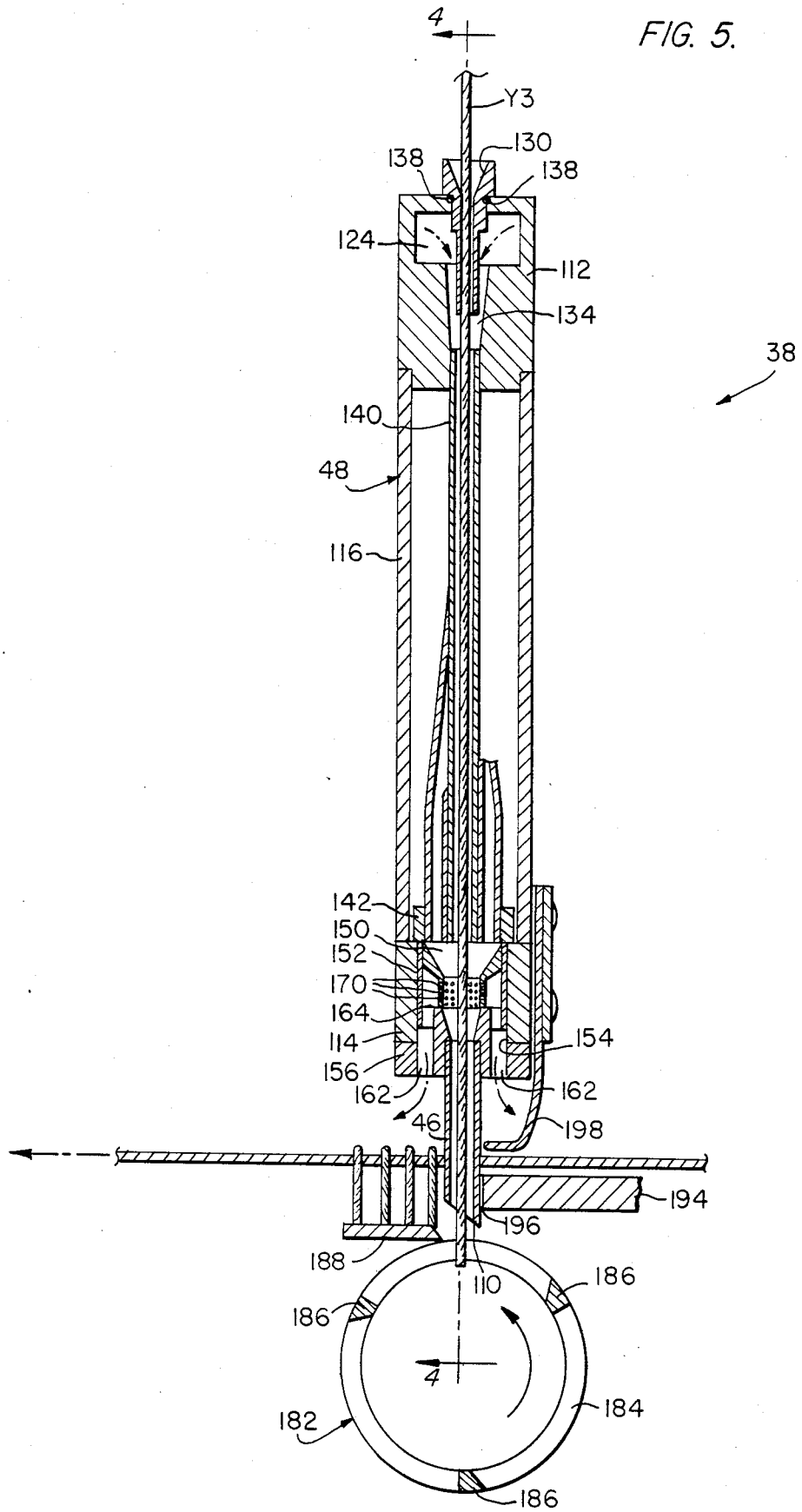
FIG. 5 is a cross sectional view taken approximately along the lines 5—5 of FIG. 4.

FIGS. 4, 5 and 6A–C illustrate in more detail the reciprocating yarn-applying element 38 of the head assembly, comprising backing opener 46 and yarn exchanger 48. As noted earlier, the function of the backing opener is to penetrate the primary backing to implant yarn therein, and the function of the yarn exchanger is to transport the selected yarns to the backing opener. As best illustrated in FIGS. 4 and 5, backing opener 46 may comprise a hollow tube, as of stainless steel, having a pointed tip 110 designed to facilitate separation of the primary backing B and penetration of the backing opener. Preferably, the inner diameter of the backing opener tube is sufficient to pass all five yarns simultaneously.

Yarn exchanger 48 may be a substantially rectangular structure comprising a top piece 112, a bottom piece 114, and a central section 116 connecting the top and bottom pieces. The top and bottom pieces may have transversely extending portions formed for connection to guide rods 40, as shown, for example, in FIGS. 4 and 6A. The guide rods may comprise cylindrical members that pass through linear bearings 42 and have threaded end portions 120 for connection to the extending portions of the top and bottom pieces. Top piece 112 may have formed in the upper portion thereof a cavity 124 which serves as a plenum and which receives air or other gas from an inlet line 126, which, as shown in FIG. 3, may be included within cable 22. A plurality of shouldered tube-like inserts 128, one for each of the different yarns, having funnel-shaped inlets 130 may extend from the upper surface 132 of top piece 112, through plenum 124, and a portion of the way into a corresponding tapered passageway 134 that connects the plenum with the lower surface 136 of the top piece. O-rings 138 may be used to provide a seal between the plenum and the inserts. A plurality of hollow tubes 140, one for each passageway, may extend downwardly from the passageways in the top piece through the central section 116 and terminate in a plate 142 mounted on the upper surface 137 of bottom piece 114. At the lower surface of the top piece, the tubes are substantially colinear with the long axis of the top piece. However, as they extend downwardly, they curve and converge together in a substantially circular cluster at plate 142, as indicated in FIG. 6B. The tubes, which may be of stainless steel, may be press fitted into passageways 134 and into corresponding holes drilled through plate 142.

Tubes-140 provide individual passageways between the top and bottom pieces for the yarns entering the yarn exchanger through inserts 128. As the yarns exit tubes 140 at the bottom piece, they enter a funnel-shaped insert 150 within the bottom piece which serves as an inlet for the backing opener and guides the yarns therethrough. The insert may be disposed within a cylindrical sleeve 152 which is pressed into a cylindrical opening 154 in the bottom piece. A backing opener clamp member 156 (shown also in FIG. 6C) is mounted on the lower surface 148 of the bottom piece. As shown in FIGS. 4 and 5, the sleeve 152 also has a funnel-shaped central portion 158 which supports insert 150 and leads into the top of the backing opener tube. As shown in FIG. 6C, the backing opener may be secured within the sleeve 152 against a shoulder of its central portion, as by set screws 160 in the clamp member 156. A plurality of holes 162 may extend upwardly through the clamp member substantially parallel to the axis of the backing opener to provide passageways that communicate with an annular cavity 164 formed between the outer surface of funnel-shaped insert 150 and the inner surface of sleeve 152. As shown in FIGS. 4 and 5, the lower cylindrical portion of the funnel-shaped insert may have a plurality of small holes 170 therethrough that provide air passageways between cavity 164 and the interior of the funnel-shaped insert.

The yarns entering the yarn exchanger through inserts 128 are transported pneumatically through the yarn tubes 140 and the backing opener 46. As shown by the arrows in FIG. 4, the pressurized air or other gas entering plenum 124 in the top piece from line 126 flows through the tapered annular space between tapered holes 134 in the top piece and the lower portions of inserts 128 and enters the tops of tubes 140. The air, which flows through tubes 140, the funnel-shaped insert 150, and the backing opener 46, exits the lower end of the backing opener, principally, and creates a vacuum in inserts 128 that moves the yarns through the tubes and the backing opener. Air passageways 170 through the lower cylindrical portion of the funnel-shaped insert enable a portion of the air entering the insert 150 to be vented into annular chamber 164 and exhausted out through holes 162 in clamp 156. Significantly, the air passageways prevent the formation of a back pressure in the funnel-shaped insert 150 and at the inlet of tubes 140 that could inhibit the transport of the yarns through the tubes and the backing opener and that could possibly cause the air to reverse its flow and exit out of the inserts 128 in the top piece 112, blowing the yarns out of the yarn exchanger. The amount of air exhausted by the air passageways 170 varies in accordance with the effective area of the air passage through the backing opener. As the number of yarns passed through the backing opener increases, its effective area decreases and a greater portion of the air is exhausted by air passageways 170. Preferably, the total area of the exhaust opening provided by the air passageways 170 is selected such that air flowing into insert 150 from tubes 140 can be substantially completely exhausted even with the backing opener totally blocked, or at least such that the yarns are not blown out of the top of the yarn exchanger. In effect, the air passageways function as a pressure regulator which maintains a substantially constant predetermined pressure at the backing opener and which affords a substantially constant force on the yarns, as the number selected varies, for transporting the yarns through the yarn exchanger and the backing opener.

During operation, a constant supply of air is provided to plenum 124 and, by virtue of air passageway 170, a substantially constant force is exerted on the yarns to transport them through the tubes 140 and the backing opener, as just described. However, only the selected yarn or yarns are allowed to pass through the backing opener, the non-selected yarns being restrained by the intermeshed gears of their yarn feeding mechanism (previously described in connection with FIG. 3). Upon a yarn being selected for implantation, its associated yarn selector actuator is actuated, as previously described. This releases the predetermined length of yarn stored in the tortuous path and allows it to be quickly transported through the backing opener by the air flow therethrough. When the yarn selector actuator is subsequently deactuated, its associated base member 60 pivots to the solid line position illustrated in FIG. 3 and the moveable guides 70 carried thereon cause a portion of the yarn (corresponding to the predetermined length of the tortuous path) that was previously supplied to the yarn exchanger to be pulled back. It is desirable to pull back non-selected yarns so that their ends are away from the outlet of the backing opener in order to minimize fraying of the yarn ends. Although the ends of yarns Y1 and Y5 in FIG. 4 are shown located within the yarn tubes 140, the ends may actually terminate within the backing opener tube at a location such that they do not exit the opening of the backing opener tube as it reciprocates. The exact locations of the ends of the non-selected yarns are not particularly important and will vary in accordance with yarn characteristics such as diameter, stiffness, elasticity, etc.

FIGS. 4 and 5 illustrate the position of the backing opener at two different times during its stroke. In FIG. 4, the backing opener is shown near the top of its stroke as it is moving downwardly to penetrate the backing B. In this figure, the backing is being advanced into the plane of the drawing, and the head assembly is being moved transversely across the backing (to the right in the figure) to implant a transverse row 180 of yarn tufts. In FIG. 5, the backing opener is shown near the bottom of its stroke, having penetrated the backing. In this figure, the backing is being advanced to the left, and the head assembly is being moved transversely across the backing in a direction normal to the plane of the drawing. As shown in these figures, as the yarn is inserted into the backing it may be cut by a rotary cutter 182, disposed on the opposite side of the backing from the head assembly. Rotary cutter 182 may comprise a pair of rotating members 184 having a plurality of angled blades 186 extending therebetween which cooperate with a stationary blade 188 to shear the yarn inserted between the stationary and the rotating blades to form cut pile tufts. The rotary cutter may be driven by an electric motor 190 and drive belt 192, for example, as shown in FIG. 3. The rotary cutter may be arranged such that its distance below the backing can be adjusted for different pile heights. An advantage of using a rotary cutter having the structure shown is that inconsistencies in the overfeed of yarns by the yarn feeding mechanisms are cut off, and a very smooth product is produced since all of the yarn tufts are cut at the same height.

A pressure plate 194 having a semicircular cutout sized to pass the backing opening may also be disposed adjacent to the opposite side of the backing from the head assembly for supporting the backing during penetration by the backing opener. As shown in FIG. 3, the rotary cutter and pressure plate may be carried on a foot assembly F that is moved transversely across the underside of the backing in synchronism with the head assembly H. The foot assembly may be supported on a pair of transversely extending rods 14' by low friction linear bearings 16' in a manner similar to the head assembly, and may be moved transversely by the same drive system employed for moving the head assemblies via a drive chain 18' coupled to the drive system. A vertically stationary presser foot 198 connected, for example, to linear bearings 42 (see FIG. 2) may also be carried by the head assembly adjacent to the backing to minimize the upward movement of the backing during retraction of the backing opener.

As is shown in FIGS. 2 and 3, reciprocation of the yarn exchanger and backing opener may be accomplished by means of a transversely extending rockable shaft 200 having a cam portion 202 that cooperates with a member 204 connected to the yarn exchanger. Shaft 200, which extends the entire transverse width of the apparatus, may be driven by a suitable head reciprocating drive system (not illustrated) which causes the shaft to undergo a predetermined back and forth angular rotation about its longitudinal axis. As the head assemblies are driven transversely across the backing, the back and forth rocking motion of the shaft imparts a synchronous reciprocating motion to the yarn exchangers and backing openers of the head assemblies, causing the backing openers to repetitively penetrate the backing as the head assemblies are moved transversely across the backing.

As is further shown in FIG. 3, the primary backing B may be supplied from a supply roll 210, fed about a roller 212, and advanced past the work-applying region 12 of the apparatus by a pair of spined rollers 214, 216 connected to a backing advance drive system (not illustrated) which incrementally advances the backing past the work-applying region after each transverse row of tufts is implanted. The spined rollers serve to maintain the backing under tension as it passes through the work-applying region. As the backing leaves the last spined roller 216, it may pass over another guide roller 218, and may be connected to a take-up system (not illustrated).

As is illustrated in FIG. 7, the apparatus may further include a control system 220 for controlling the backing advance drive system, the head traverse drive system, the head reciprocate drive system, and the yarn selector and feeding mechanisms. Control system 220, which is preferably a microcomputer, controls the timing and the actuation of the drive systems and the yarn selector and feeding mechanisms of the apparatus. The microcomputer conveniently enables the amount of advancement of the primary backing to be varied so as to vary the spacing between transverse rows of tufts, and conveniently enables variation in the yarn insertion locations (as by controlling a stepping motor, for example, in the head traverse drive system) so as to vary the distances between yarn tufts in a transverse row. Moreover, a microcomputer may be easily programmed so as to enable different patterns or designs to be produced.

A complete operating cycle of the apparatus of FIG. 1 will now be described. Initially, it should be noted that the head assemblies H are moved first in one direction across the width of the backing to implant a first transverse row of tufts, the backing is advanced to the location of the next row of tufts, and the head assemblies are then moved in the opposite direction to implant that row of tufts. Assuming that the left-hand head assembly of FIG. 1 is positioned at the left side of the backing and that the backing has been advanced to the position of the next transverse row, the right-hand head assembly will be positioned such that its backing opener is at the midpoint of the width of the backing. The head assemblies are then moved transversely across the backing such that the left-hand head assembly implants tufts in the left side of the backing and the right-hand head assembly implants tufts in the right half of the backing. Upon completing the transverse row, the backing is incrementally advanced to the position of the next transverse row, and the head assemblies are driven in the opposite direction, i.e., right-to-left in FIG. 1, to implant that transverse row of tufts. This process is repeated with the head assemblies moving in opposite directions for succeeding rows until transverse rows have been implanted in a desired length of the backing. As previously noted, the apparatus may employ more than two head assemblies, e.g., twenty-three for a fifteen foot backing width, in which case the operation would be the same except that each head assembly would be required to cover a smaller segment of the width.

The head traverse drive system preferably incrementally steps the head assemblies a distance equal to the desired distance between successive yarn implantations during the portion of the stroke when the backing opener is withdrawn from the backing. Alternatively, the transverse drive system could move the head assemblies continuously. Although this would result in some pulling of the backing as the backing opener is moved while it is inserted into the backing, the backing would quickly readjust itself upon the backing opener being withdrawn. The head reciprocation drive system may also be operated intermittently, although it is preferred to operate it continuously, in which case the speed of the transverse drive system would be adjusted so as to afford the desired distance between successive penetrations.

The selection of the yarn or yarns to be implanted at each insertion of the backing opener is made at the bottom of the backing opener stroke (the timing of the control signals which control yarn selector actuators 76 may be adjusted so as to occur prior to the bottom of the stroke to compensate for delay in the reaction times of the mechanism). Upon a yarn being selected for implantation, the selector actuator 76 of its corresponding yarn selector and feeding mechansim is actuated to pivot its corresponding base member 60 counter-clockwise (in FIG. 3) as previously described. This moves moveable yarn guides 70 into substantial alignment with fixed yarn guides 80, thereby providing a substantially straight path for the yarn from intermeshed gears 66 and 68 to the yarn exchanger and releasing the stored length of yarn. Upon being released, the yarn is quickly pulled through its yarn exchanger tube and the backing opener by the air flowing therethrough, and is sheared by the rotary cutter. As the backing opener moves upwardly to the top of its stroke and moves transversely to the location of the next yarn tuft, the air flow through the backing opener maintains the yarn in place within the backing. Then, as the backing opener moves downwardly during the next portion of the stroke, drum 64 rotates clockwise, as previously described, imparting rotation to gears 66 and 68 to feed a length of yarn at least sufficient to exit the outlet of the backing opener. Once selected, a particular yarn remains selected for at least one complete cycle of the backing opener, i.e., from the bottom of one stroke to the bottom of the next succeeding stroke, comprising two successive insertions of the backing opener into the backing. As shown in FIG. 4, this leaves inverted U-shaped lengths of yarn tufts implanted in the backing.

The de-selection of a previously selected yarn also occurs at the bottom of the backing opener stroke. Upon the selector actuator of the de-selected yarn being deactuated, its corresponding base member 60 pivots (under the influence of spring 72) back to the solid line position illustrated in FIG. 3. The movement of yarn guides 70 relative to fixed yarn guides 80 causes the de-selected yarn to be pulled back from the exit of the backing opener (and out of the backing) up into either the backing opener tube, the funnel-shaped insert 150 or its yarn supply tube 140, as previously described. Simultaneously, the selector actuator of a desired yarn or yarns, if any, is actuated allowing the length of the selected yarn that was previously pulled back to be released from temporary storage and transported through the backing opener, as described above.

FIG. 4 illustrates a portion of a transverse row 180 of U-shaped yarn tufts implanted in backing B. As previously described, different yarns (Y1, Y5 and Y3, for example) may be selected for each successive tuft, as shown in region 230; no yarns may be implanted at a location, as shown at 232; or a plurality of different yarns (Y2 and Y4, for example) may be implanted at a particular location, as shown at 234.

From the foregoing, it will be appreciated that the invention may be used with any combination of yarns of different color, size, character or type, and affords remarkable flexibility in the implantation of the different yarns into a backing, thereby enabling the production of tufted goods embodying patterns or designs heretofore unavailable except by printing or with woven goods produced on a loom. Moreover, the invention affords significant advantages over other known apparatus and methods in its ability to produce carved cr sculptured patterns, as by omitting tufts in selected areas, or by varying the spacings between tufts. Also, the invention enables goods having a varying density to be readily produced.

While a preferred embodiment of the invention has been shown and described, it will be appreciated by those skilled in the art that changes may be made in this embodiment without departing from the principles and spirit of the invention, the scope of which is defined in the appended claims.

What is claimed is:

1. Apparatus for producing patterned tufted goods, comprising means for advancing a backing past a yarn-applying region; yarn-applying means disposed at the yarn-applying region for penetrating the backing and for implanting yarn therein, the yarn-applying means being movable transversely to the direction of advancement of the backing for successively implanting yarn along a transverse row; means for supplying a plurality of different yarns to the yarn-applying means; and means for controlling the supplying means in accordance with a predetermined pattern to select which of said yarns or combinations of said yarns, if any, is implanted in the backing at each said penetration.

2. The apparatus of claim 1, wherein the supplying means includes means for supplying continuous lengths of said yarns to the yarn-applying means, and the controlling means includes means for selecting all, none, or any number of said yarns for implantation in the backing at each said penetration.

3. The apparatus of claim 1, wherein said yarn-applying means comprises a backing opener, and means is included for reciprocating the yarn-applying means so as to cause the backing opener to penetrate repetitively the backing.

4. The apparatus of claim 3, wherein the supplying means comprises a plurality of yarn supply tubes, the yarn supply tubes converging at a funnel-shaped member disposed at an inlet at the backing opener, and pneumatic means for providing a gas flow through the yarn supply tubes, the funnel-shaped member, and the backing opener for transporting said yarns therethrough.

5. The apparatus of claim 4, wherein the yarn supply tubes originate in tapered passageways that are in communication with a plenum to which a pressurized source of said gas is connected, the yarns being supplied to said yarn supply tubes through tubular members which extend through said plenum and into said tapered passageways.

6. The apparatus of claim 4 further comprising pressure regulating means for maintaining a predetermined pressure at the inlet of the backing opener as the number of yarns transported through the backing opener varies.

7. The apparatus of claim 6, wherein the funnel-shaped member has a plurality of apertures therein for venting a portion of the gas flowing through such member, said apertures comprising said pressure regulating means.

8. The apparatus of claim 7, wherein said apertures have a total area that is selected to vent a sufficient amount of said gas so as to avoid formation of a back pressure in said yarn supply tubes.

9. The apparatus of claim 8, wherein said apertures are in communication with a cavity that surrounds the funnel-shaped member, and said cavity is vented to the atmosphere.

10. The apparatus of claim 3, wherein the supplying means comprises means for temporarily storing a preselected length of each of said yarns, and the control means includes means operable upon a yarn being selected for implantation to release the stored preselected length of such selected yarn so as to enable the selected yarn to be transported through the backing opener.

11. The apparatus of claim 10, wherein said temporary storing means comprises movable means for imparting a tortuous path to each of the yarns supplied to the yarn-applying means.

12. The apparatus of claim 11, wherein said movable means comprises, for each of said yarns, first yarn guides disposed on a movable member which at a first position cooperates with fixed second yarn guides for imparting said tortuous path to the yarn, and means responsive to the selection of the yarn for moving the movable member to a second position at which said first and second yarn guides are in substantial alignment.

13. The apparatus of claim 12, wherein said controlling means is operable to select or to de-select yarns at a time when the backing opener has penetrated the backing, and wherein the movable member of a de-selected yarn, upon movement to the first position, pulls back the de-selected yarn away from an exit opening of the backing opener.

14. The apparatus of claim 10, wherein the supplying means further comprises yarn feeding means for feeding lengths of selected yarns to the backing opener.

15. The apparatus of claim 14, wherein the yarn feeding means is driven by the reciprocating yarn-applying means to feed said lengths of selected yarns.

16. The apparatus of claim 15, wherein the yarn feeding means comprises first rotatable means coupled to the yarn-applying means by means for imparting rotation to the first rotatable means during movement of the backing opener to penetrate the backing, and a plurality of second rotatable means engaging said plurality of yarns, and wherein said controlling means comprising means for moving the second rotatable means which engages selected yarns into engagement with the first rotatable means so as to feed the selected yarns to the backing opener.

17. The apparatus of claim 16, wherein said means for moving the second rotatable means comprises actuator means for pivoting the second rotatable means into engagement with the first rotatable means.

18. The apparatus of claim 16, wherein the rotation imparting means comprises means for imparting a predetermined angular rotation in a predetermined direction to the first rotatable means during a penetration stroke of the yarn-applying means.

19. The apparatus of claim 18, wherein the first rotatable means comprises a drum, and the rotation imparting means comprises a one-way clutch and a link mechanism coupled to the one-way clutch and to the yarn-applying means, the link mechanism being formed to enable adjustment of the amount of angular rotation of the drum.

20. The apparatus of claim 16, wherein the second rotatable means comprises, for each of said yarns, intermeshed gears disposed upon a pivotal member, the yarn passing between the intermeshed gears and the gears being formed so as to prevent non-selected yarns from being transported through the backing opener.

21. The apparatus of claim 1 further comprising another controlling means for controlling the movement of the yarn-applying means in accordance with said predetermined pattern so as to select the locations in the row at which yarn is implanted.

22. The apparatus of claim 21, wherein said yarn-applying means, said supplying means, and said first-mentioned controlling means are disposed on a transversely movable assembly, and wherein said other controlling means includes means for moving the assembly in a forward and in a reverse direction transversely across the backing, the yarn-applying means being formed to implant yarn during movement in both such directions.

23. The apparatus of claim 22, wherein the apparatus comprises a plurality of such transversely moveable assemblies, each assembly including yarn-applying means, supplying means, and first-mentioned controlling means.

24. The apparatus of claim 23, wherein the yarn-applying means comprises a reciprocating backing opener through which selected yarns are applied to the backing, and wherein the apparatus further comprises common reciprocating means for reciprocating in synchronism the yarn-applying means of each of said assemblies, and common drive means for moving said plurality of assemblies in synchronism transversely across the backing.

25. The apparatus of claim 1 further comprising cutting means disposed on the opposite side of the backing from the yarn-applying means for cutting the yarn implanted into the backing.

26. The apparatus of claim 25 further comprising means for moving the cutting means transversely with respect to the backing in accordance with the movement of the yarn-applying means.

27. The apparatus of claim 26, wherein the cutting means comprises a rotary cutter having a plurality of rotating blades which cooperate with a stationary blade for shearing the yarn.

28. Apparatus for producing patterned tufted goods comprising a backing opener for penetrating a backing and for implanting yarn therein; a plurality of yarn supply tubes converging at an inlet of the backing opener for conveying a plurality of different yarns entering the tubes to the backing opener; pneumatic means for producing a gas flow through the yarn supply tubes and through the backing opener for transporting the yarns therethrough; means for selecting in accordance with a predetermined pattern which yarn or combination of yarns, if any, is supplied to the backing opener for implantation into the backing at each penetration of the backing; and pressure regulating means disposed at the inlet of the backing opener for maintaining a predetermined pressure at said inlet as the number of yarns selected by the selecting means varies.

29. The apparatus of claim 28, wherein the pressure regulating means comprises a funnel-shaped member disposed at the inlet of the backing opener, the member having a plurality of apertures therein for venting a portion of the gas flow through the member.

30. The apparatus of claim 29, wherein said apertures are formed such that the amount of gas vented varies in accordance with the number of yarns passing through the backing opener.

31. The apparatus of claim 30, wherein said apertures have a total area that is selected to vent a sufficient amount of said gas so as to avoid formation of a back pressure in said yarn supply tubes.

32. The apparatus of claim 28, wherein the pneumatic means provides a continuous gas flow through the yarn supply tubes and through the backing opener, and wherein the selecting means includes means for releasing the selected yarns to enable such yarns to be transported through the yarn supply tubes and the backing opener.

33. The apparatus of claim 32 further comprising means for temporarily storing a preselected length of each of said yarns prior to the yarns entering the yarn supply tubes, and said releasing means includes means for releasing from said temporary storing means the preselected lengths of the selected yarns.

34. The apparatus of claim 33, wherein the selecting means is operable, upon the de-selection of a previously selected yarn, pulling back into said temporary storing means a length equal to the preselected length of said yarn.

35. The apparatus of claim 28 further comprising cutting means disposed on the opposite side of the backing from said backing opener for cutting the yarns implanted in the backing.

36. A method of producing patterned tufted goods using automatic apparatus comprising advancing a backing past a yarn-applying region; moving a yarn-applying element transversely across the backing with respect to the direction of advancement; supplying a plurality of different yarns to said yarn-applying element; and applying yarn to the backing with the yarn-applying element by successively implanting yarn in the backing at a plurality of locations along a transverse row, said implanting including automatic selecting in accordance with a predetermined pattern which yarn or combination of yarns of said plurality of yarns, if any, is implanted at each location.

37. The method of claim 36, wherein said supplying comprises applying a continuous force to each of said plurality of yarns to transport said yarns in continuous lengths to said yarn-applying element, and wherein said selecting comprises restraining non-selected yarns so as to prevent such yarns from being transported to the yarn-applying element, and releasing selected yarns so as to permit such yarns to be transported to the yarn-applying element.

38. The method of claim 37, wherein said yarn-applying element is a backing opener tube which penetrates the backing and through which the selected yarns are fed, and wherein said supplying comprises conveying the yarns through individual passageways to an inlet of the backing opener tube by providing a flow of gas through said passageways and said backing opener tube to apply said continuous force to the yarns, and venting a portion of the gas at said inlet, the portion of the gas vented being varied in accordance with the number of yarns transported through the backing opener tube so as to avoid the formation of a back pressure at said inlet.

39. The method of claim 36, wherein said selecting comprises selecting in accordance with the predetermined pattern the location in the transverse row for each yarn implantation.

40. The method of claim 39, wherein said selecting comprises controlling the movement of the yarn-applying element between yarn implantations so as to select the location of each implantation.

* * * * *